US007437843B2

(12) United States Patent
Lefebvre

(10) Patent No.: US 7,437,843 B2
(45) Date of Patent: Oct. 21, 2008

(54) BANNER MOUNTING SYSTEM

(76) Inventor: Hugues Y. Lefebvre, 3716 City of Oaks Wynd, Raleigh, NC (US) 27612

( * ) Notice: Subject to any disclaimer, the term of this patent is extended or adjusted under 35 U.S.C. 154(b) by 67 days.

(21) Appl. No.: 11/614,161

(22) Filed: Dec. 21, 2006

(65) Prior Publication Data

US 2008/0148613 A1 Jun. 26, 2008

(51) Int. Cl.

| | |
|---|---|
| ***G09F 7/00*** | (2006.01) |
| ***G09F 17/00*** | (2006.01) |
| ***F16M 11/00*** | (2006.01) |
| ***F16M 13/00*** | (2006.01) |
| ***B65H 75/38*** | (2006.01) |
| ***B65H 75/30*** | (2006.01) |
| ***B65H 16/10*** | (2006.01) |
| ***B65H 19/16*** | (2006.01) |
| ***B65H 49/34*** | (2006.01) |
| ***B65H 18/10*** | (2006.01) |
| ***B65H 18/14*** | (2006.01) |

(52) U.S. Cl. ..... 40/601; 40/604; 242/395; 242/564.2; 242/546.1; 248/157; 248/422; 248/326; 248/328; 248/327; 248/320; 248/125.2; 248/125.8; 248/158; 248/161; 248/292.12

(58) Field of Classification Search ..... 40/601, 40/604; 248/326, 327, 328, 320, 125.2, 125.8, 248/158, 161, 422, 157, 292.12; 242/283, 242/395, 564.2, 265, 267, 380, 378, 546.1
See application file for complete search history.

(56) References Cited

U.S. PATENT DOCUMENTS

| | | | | |
|---|---|---|---|---|
| 633,051 | A * | 9/1899 | Spicer et al. | 5/611 |
| 5,253,608 | A | 10/1993 | Burke | |
| 6,484,992 | B1 | 11/2002 | Svensson et al. | |
| 6,668,750 | B1 | 12/2003 | Walz et al. | |
| 6,718,668 | B2 | 4/2004 | Cozzilino | |
| 6,758,159 | B2 | 7/2004 | McCudden et al. | |
| 7,000,344 | B2 * | 2/2006 | Furlan et al. | 40/601 |

* cited by examiner

*Primary Examiner*—Lesley D. Morris
*Assistant Examiner*—Syed A Islam
(74) *Attorney, Agent, or Firm*—Moore & Van Allen, PLLC; Dominic J. Chiantera

(57) ABSTRACT

Apparatus for mounting a banner from a support member at a display height above ground level includes upper and lower banner mounting arms that are capable of receiving and mounting a banner with the assistance of an operator located at ground level.

24 Claims, 9 Drawing Sheets

BANNER MOUNTING SYSTEM

COPYRIGHT

The contents of this document are subject to copyright protection. The copyright owner maintains all rights in copyright to such contents but has no objection to their reproduction in the form published by the United States Patent and Trademark Office.

TECHNICAL FIELD

This invention relates to the field of banners, and more particularly to apparatus used to mount banners in their display position.

BACKGROUND ART

Banners are articles that are similar in form and structure to flags, and while they may be used as a flag to display the identifying standard of a government or private organization, they are more commonly used to display information to the public. The displayed information may be text, such as the name and address of an organization, or graphics, such as the organization's logo. Banners, like flags, are made of flexible sheet material (cloth or vinyl; either solid or perforated) that is referred to as a blank, and is generally provided in a rectangular or square format. The blank's opposite side major surfaces provide the banner's fields on which the information is displayed.

FIG. 16 is an perspective illustration of a typical prior art banner 20 having a rectangular blank 22 with opposite side major surfaces 24, 26. The text or graphic field information to be displayed is applied to one or both major surfaces 24, 26; typically by screen printing. In contrast to flags, which generally fly freely from a halyard at their hoist end, banners are usually secured in a manner which holds them taut in their mounting, to prevent them from flapping, thereby allowing the field information to be more easily read by onlookers. To facilitate this, sleeves 28, 30 are formed at the mounting ends of the blank 22 by folding over the blank's free edges and stitching them along seams 32, 34 to the field. The banner may then be mounted by slipping the sleeves over the top and bottom rods or brackets of mounting apparatus that secures the brackets to a mounting surface at mutual relative spacing that holds the banner taut.

FIG. 17 is an elevation drawing of prior art banner mounting apparatus that is adapted for mounting to a pole 35. The mounting apparatus includes upper and lower mounting brackets 36, 38, each with mounting bases 40, 42 that are connected to the pole 35 through straps 44, 46. The brackets 36, 38 slip through the sleeves 28, 30 of the banner 20 and the straps are adjusted to position the brackets at an intermediate spacing, which is sufficient to tension the banner to hold it taut. While there are variations in the way the brackets 36, 38 of various prior art mounting systems are fixed to their mounted surfaces, their common characteristic is the need for the banner installer to physically place the banner sleeves over the mounting brackets to secure the banner in its mounting.

Since banners are most commonly placed at a height that ensures their visibility to pedestrian and vehicle traffic, they are typically installed on their own poles, or available utility poles, lamp posts, and building facades. Their installation is difficult, possibly dangerous, and expensive since it is time consuming and requires the use of a bucket truck or ladder to give the installer access. This limits their utility for advertising applications where frequent change is required. It may also limit their usable life, since without easy removal they are installed for longer periods and suffer greater weathering.

There is a need, therefore, for a banner mounting system that permits easier and faster installation so as to reduce the cost and risk of the task.

DISCLOSURE OF INVENTION

One object of the present invention is to provide method and apparatus that permits an operator located at ground level to mount banners at display heights above ground level. Another object of the present invention is to provide a method and apparatus for quickly and easily mounting banners at display heights above ground level. A still further object of the present invention is to provide a method and apparatus for mounting a banner that minimizes the opportunity for theft of or vandalism to the banner.

According to the present invention, apparatus for mounting a banner includes upper and lower banner arm assemblies that are mounted to a support structure at relative heights determined by the display height and banner length, and a lower crossbar which attaches to the lower edge of the banner, the upper banner arm assembly having hoist shaft apparatus, with a hoist means that attaches to an upper edge of the banner, and which is adapted to raise and lower the banner through rotational torque applied to the upper banner arm assembly from a crank shaft operated by a ground level operator, the lower banner arm assembly having a banner passage formed therethrough, between upper and lower surfaces thereof, with a passage geometry that permits the banner to pass through it, the apparatus further having a lower crossbar adapted to releasably engage a lower mounting edge of the banner, and having a lower crossbar geometry that prevents it from passing through the banner passage during the banner mounting process in which the operator engages the lower crossbar to the lower edge of the banner and rotates the crank shaft to lower the hoist means, guiding it on a descent path through the banner passage, to a height which permits the operator to engage the hoist means and to the upper edge of the banner, and to rotate the crank assembly to raise the hoist means on a return ascent path through the banner passage, together with the engaged banner and lower crossbar, to a height at which the banner passage blocks further vertical travel of the lower crossbar, at which point the banner is secured in its mounted position.

In further accord with the present invention, the upper banner arm assembly further includes a self locking drive shaft, the drive shaft being in a locked state at all times in the absence of an unlocking force applied by the operator through the crankshaft.

In still further accord with the present invention, the crank shaft comprises a fixed shaft, which is mounted between the upper and lower banner arm assemblies, and a removable shaft section which the operator uses in mounting and dismounting a banner by operatively engaging the removable shaft section to the fixed shaft and then removing it when completed. In yet still further accord with the present invention, the fixed shaft portion of the crank shaft is provided with a variable length to accommodate changes in spacing between the upper and lower banner arm assemblies as necessary to facilitate changes in banner lengths.

The Banner Mounting System of the present invention provides a simple and quick method of installing and removing banners which does not require the installer to leave the ground. This eliminates the need for ladders, and their inherent risk of injury in their use, as well as drastically reducing the cost of installing/changing banners. The cost of renting a bucket truck, of labor, and in many cases of removing cars and other items which may impede bucket truck access, can be prohibitive. The ease of use and simplicity it provides to the task allows for the mounting and removal of banners by a broader group of installers, since it is less physically demanding. This increases banner utility for use in advertising since the messages can more readily be changed in keeping with the current marketing objective.

These and other objects, features, and advantages of the present invention will become more apparent in light of the following detailed description of a best mode embodiment thereof, as illustrated in the accompanying Drawing.

BEST MODE FOR CARRYING OUT THE INVENTION

Figure 1:
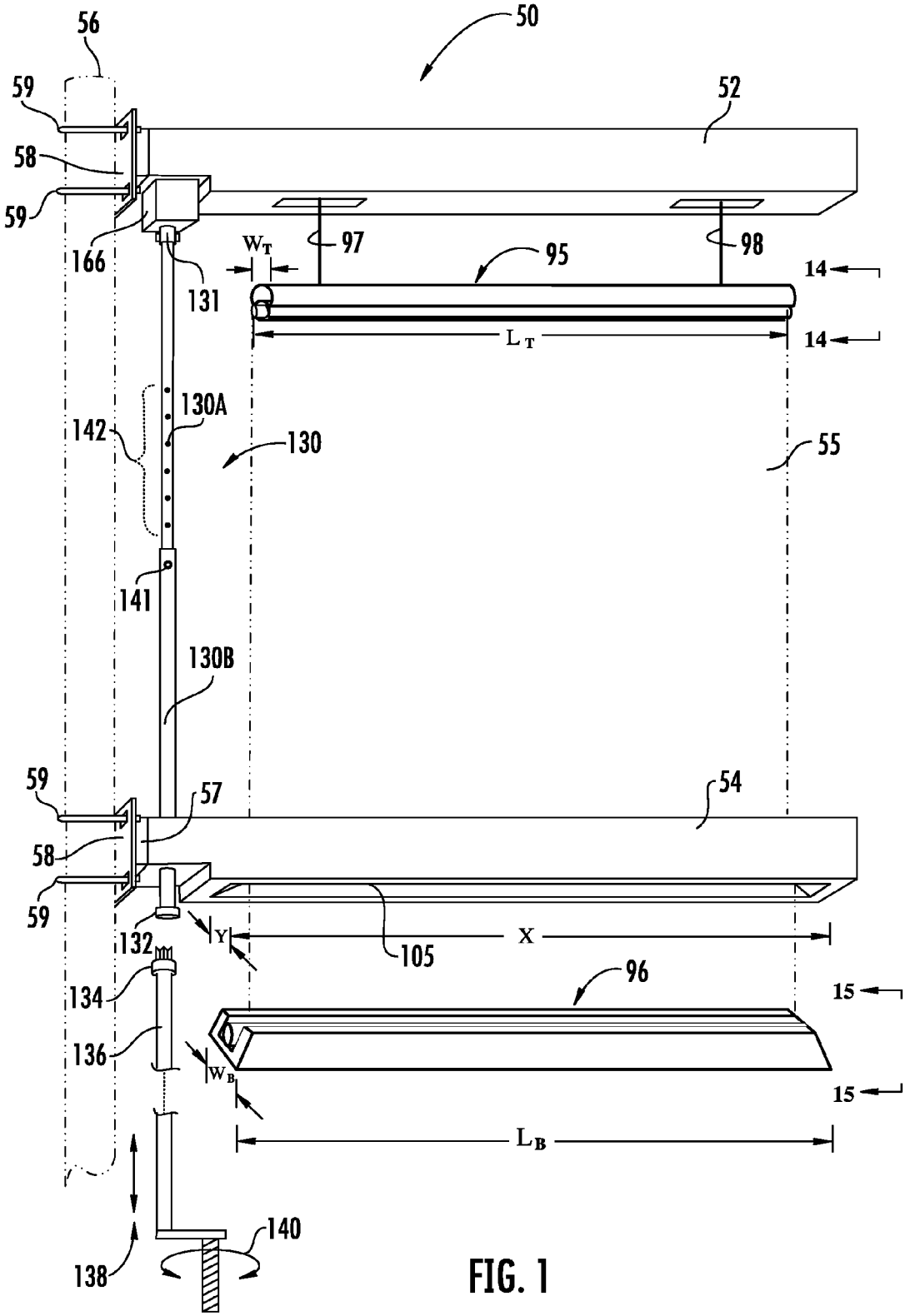
FIG. 1 is a perspective illustration, not to scale, of a best mode embodiment of the Banner Mounting System of the present invention.

FIG. 1 is a perspective illustration, not to scale, of a best mode embodiment of the Banner Mounting System 50 of the present invention. The System 50 includes upper and lower banner mounting arms 52, 54 which together fix and secure a banner 55 in its mounted position. As typical of their practical use, banners are mounted above ground level to provide onlookers with a good line of sight to the displayed information. To ensure both line of sight as well as safe ground clearance for people and vehicles, banners and their mounting hardware are usually positioned at least ten feet, typically ten to twelve feet, above ground level. With banner lengths of from five to eight feet, the upper bracket must then be fifteen to twenty feet above ground level.

In the embodiment of FIG. 1 the System 50 is mounted on a pole 56, which may be an existing lamp or utility pole, or a pole that is dedicated to mounting the banner 56. The pole mounting, however, is discretionary, and is not a part of the invention itself. The System 50 may be used with any suitable alternative mounting surfaces, such as a building facade or other structure. In the embodiment of FIG. 1 the banner arms 52, 54 are connected to the pole 56 through the engagement of connectors 57, located at the mounting end of each of the banner arms 52, 54, to pole brackets 58. The pole brackets 58 are fastened to the pole with clamps 59.

Figures 3, 4, 5:
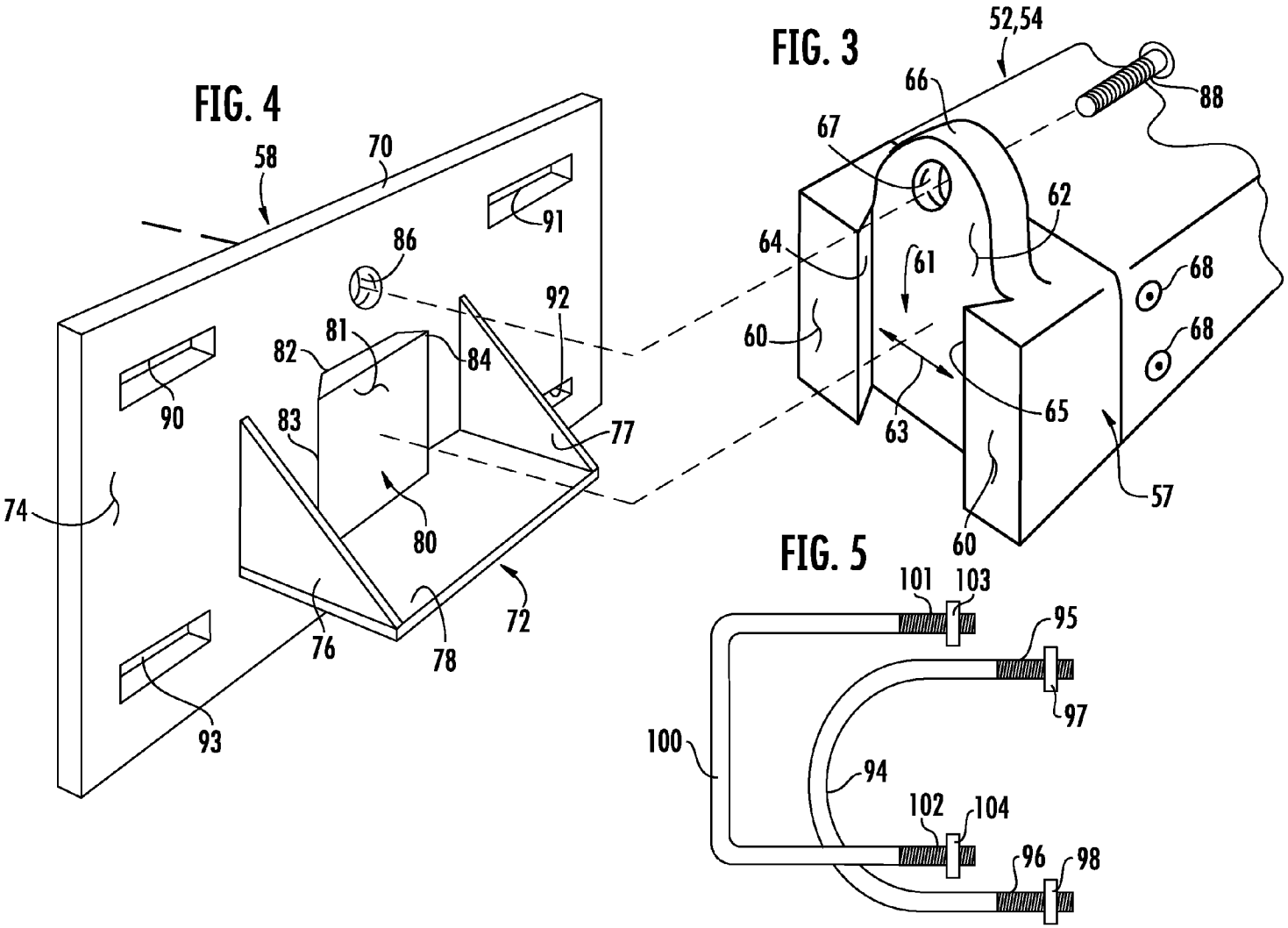
FIG. 3, is a perspective illustration, not to scale, of a component of the System embodiment of FIG. 1.
FIG. 4, is a perspective illustration, not to scale, of another component of the System embodiment of FIG. 1.
FIG. 5, is a plan view, not to scale, of yet another component of the System embodiment of FIG. 1.

Referring simultaneously to FIGS. 3, 4 and 5, each of which are perspective illustrations, not to scale, of the connector 57, pole bracket 58, and clamps 59. In the best mode embodiment, the connector 57 (FIG. 3) has a generally rectangular shape, with an end wall 60 having an open, three sided mortise 61 formed therein. The mortise geometry is in the form of a wedged half dovetail in which the mortise back wall 62 is wider than the opening 63 between the terminal end of the mortise side walls 64, 65, which project at acute angles from the back wall 62. The back wall 62 extends upward from the mortise 61 to form a mounting tab 66 that includes a mounting hole 67 which is adapted to receive a fastener that is used to secure the connector 57 to the pole bracket 58. In the best mode embodiment the connector 57 is made of steel, however, such alternative materials as are deemed suitable by those skilled in the art may be used. The connector 57 is fitted to the housings of the upper and lower banner arms 52, 54 (FIG. 1) using suitable fasteners, such as screws 68.

The pole bracket 58 (FIG. 4) comprises a substantially rectangular steel plate 70 having a three sided steel fixture 72 that projects from the pole bracket's major surface 74. The fixture 72 has side walls 76, 77 which are joined to a bottom wall 78 to collectively form a holder which is adapted to receive and support the connector 57. A tenon 80, with front and back tenon surfaces 81, 82 projects from the major surface 74 within the area bounded by the fixture 72. The tenon 80 is adapted in its geometry and the mutual spacing of the front and back tenon surfaces 81, 82 to fit within the wedged half dovetail mortise 61 of the connector 57. In the mounting operation the connector 57 is positioned over and seated into the fixture 72 and the tenon 80 slips into the mortise 61. The side walls 83, 84 of the tenon 80 bear against the side walls 64, 65 of the mortise to hold the connector and attached banner arm (52, 54 of FIG. 1) in position in an approximate orthogonal orientation to the major surface 74. The plate 70 includes a mounting hole 86 that is tapped with a selected, known type thread design. When the connector 57 is positioned in the fixture 72, the hole 86 is in registration with the hole 67 of the connector, and a like-threaded fastener 88 may be used to secure the connector 57 and bracket 58 together.

To facilitate its mounting to the pole 56 (FIG. 1) the bracket 58 includes elongated openings, or slots 90-93 that are adapted to receive the clamps 59 (FIG. 1). The clamps 59 are known type U clamps that may be provided in either a rounded or square configuration for use with round or square poles. FIG. 5, illustrates a rounded U clamp 94 of the type that may be used. The clamp 94 has threaded ends 95, 96 that are adapted to be fitted through the openings 90-93 of the bracket 58 and secured with fasteners 97, 98. Alternatively, a square clamp 100 has threaded ends 101, 102 which fit through the openings 90-93 of the bracket 58 and which may be secured with fasteners 103, 104.

Referring again to FIG. 1, the System 50 includes upper and lower banner crossbars 95, 96 that are adapted for connecting the banner 55 to the system 50 prior to hoisting it into its mounted position. The upper crossbar 95 is connected through halyard lines 97, 98 to the upper banner arm 52. It is subjected directly to the hoisting force exerted by the halyard lines in raising the banner into position. In the hoisting process the upper crossbar must support and raise the banner 55 and the lower crossbar 96 which follow it into their mounted position. As described in detail hereinafter, the lower banner arm 54 includes a central opening, or chute 105, which the upper crossbar must pass through in hoisting and lowering the banner 55. Therefore, the upper crossbar has a length $L_T$ and a width $W_T$ (i.e. front-to-back dimension) which is less than the length X and the width Y of the chute 105 (i.e. $L_T<X$ and $W_T<Y$). The lower crossbar 96, however, is adapted to provide an interference fit with the chute 105, and it is provided with a length $L_B$ and width $W_B$ greater than the length X and width Y of the chute 105, so that $L_B>X$ and $W_B>Y$. The relative sizes of the lower crossbar 54, the chute 105, and the upper crossbar 95 are, therefore: $L_B>X>L_T$, and $W_B>Y>W_T$.

Figure 12:
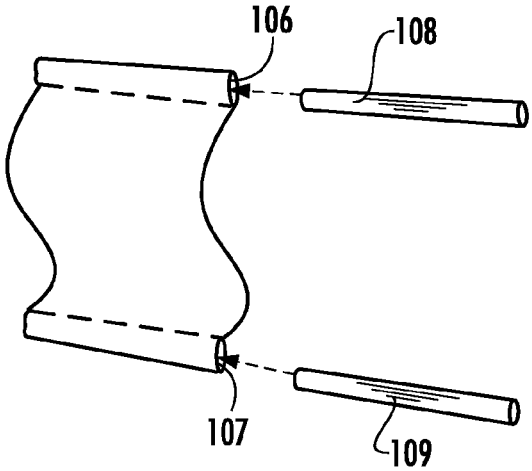
FIG. 12, is a perspective illustration of a banner and accompanying accessories that may be used with the Banner Mounting System embodiment of FIG. 1.
Figure 16:
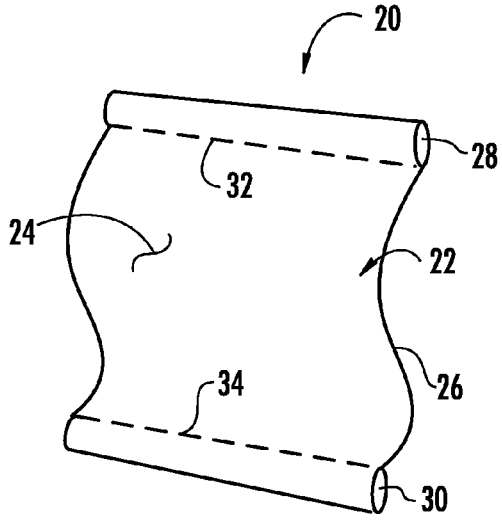
FIG. 16 (PRIOR ART)
FIG. 16, is a perspective illustration of a prior art banner used in a description of the Background to the Banner Mounting System embodiment of FIG. 1.
Figure 17:
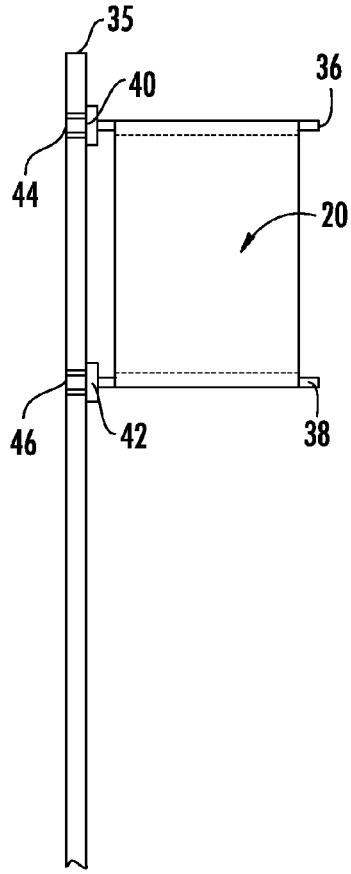
FIG. 17 (PRIOR ART)
FIG. 17, is an elevation view of a prior art banner mounting system.

The crossbars are each adapted to releasably engage the mounting ends of the banner 55, which may be a prior art banner of the type shown in FIG. 16. Referring to FIG. 12, the banner 55 includes sleeves 106, 107 at opposite side edges from which the banner is to be mounted. The sleeves are adapted to receive rods 108, 109 which comprise suitably solid materials such as metal, wood or polyvinyl chloride ("PVC"). The rods 108, 109 are preferably cylindrical to enable their easy insertion into the sleeves 106, 107, however, such alternative shaped rods as are deemed suitable by those skilled in the art may also be sued. In the best mode embodiment the rods have a diameter which is equal to or less than one half (½) inch (approximate 12.5 millimeters), and are made of wood. The rods are inserted into the sleeves to provide the assembled banner 110 of FIG. 13.

Figure 14:
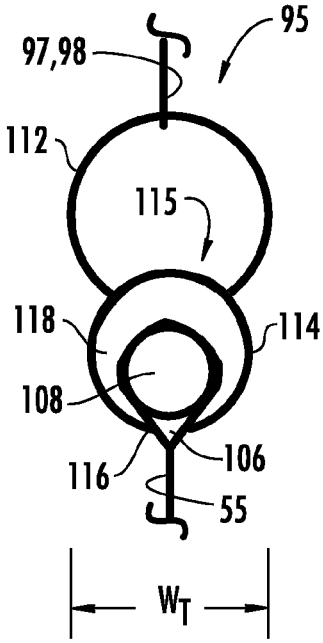
FIG. 14, is a section illustration taken along the line 14-14 of FIG. 1.

FIG. 14 is a cross section of the upper crossbar 95 taken along the line 14-14 of FIG. 1. In the best mode embodiment the upper crossbar is a two piece assembly comprising dual cylinders 112, 114 which are joined to form a single unit. The diameter of cylinder 112 is greater than that of 114, and it establishes the width $W_T$ of the upper crossbar 95 as described hereinbefore with respect to FIG. 1. The cylinder 112 is adapted to receive halyard lines 97, 98. The smaller diameter cylinder 114 is positioned below the cylinder 112 when the combination is installed as the upper crossbar 95 in the system 50, and it is adapted to receive the banner 55. In the best mode embodiment, the cylinder 114 is fitted in and welded along a longitudinal slot 115 that is provided along the bottom length $L_T$ of cylinder 112

Cylinder 114 also includes an open slot 116 formed along an opposite side surface from that at which it is welded to cylinder 112, i.e. along its bottom when the crossbar is installed in the system 50. The slot 116 extends the full length $L_T$ of the cylinder 114. The diameter of the cylinder 114 is selected to allow the banner sleeve 106 and inserted rod 108 of the assembled banner 110 (FIG. 13) to easily slide through the interior 118. The width dimension of the slot, i.e. the length of the arc section that was removed from the cylinder 114 to form the slot 116, is selected to permit easy lengthwise passage of the banner 55 therethrough, but to prevent the banner sleeve 106 and rod 108 combination from falling through it. The cylinder 114 and slot 116 must withstand the load stresses associated with taut mounting of the banner 55, as well as wind on the mounted banner, without suffering distortion which can result in releasing the mounted banner from the upper crossbar. Therefore, in the best mode embodiment the cylinders 112, 114 are made of steel. It should be understood, however, that such alternative materials as are deemed suitable by those skilled in the art may also be used.

Figure 13:
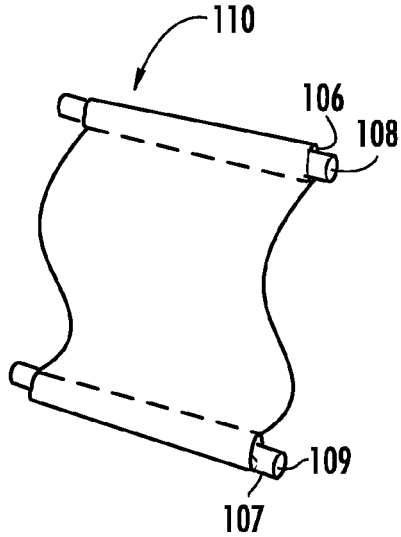
FIG. 13, is a perspective illustration of the assembled banner of FIG. 12.
Figure 15:
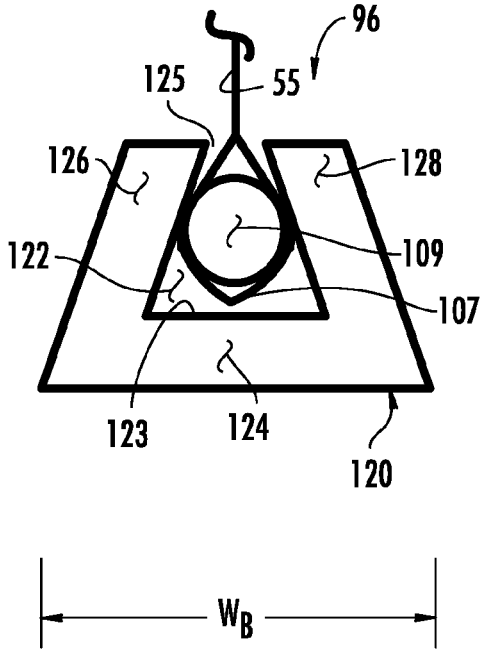
FIG. 15, is a section illustration taken along the line 15-15 of FIG. 1.

FIG. 15 is a cross section of the lower crossbar 96 taken along the line 15-15 of FIG. 1. The lower crossbar 96 includes a housing 120 that encloses a mortised channel 122 formed along the length $L_B$ of the lower crossbar. The channel 122 is adapted to receive the banner sleeve 107 and rod 109 of the assembled banner 110 (FIG. 13). The mortise configuration of channel 122 is three sided, being open on one side, similar in type to a wedged half dovetail mortise in which the mortise end wall 123 (the interior surface of the base wall 124 of the housing 120) is wider than the opening 125 formed at the terminal ends of the housing sidewalls 126, 128, which extend from the base wall 124 at acute angles.

The housing width $W_B$, which is the width of the base wall 124, is selected to satisfy the relationship described above with respect to FIG. 1, where $W_B>Y>W_T$. Subject to this limitation, and subject further to the requirement that the lower crossbar must provide an interference fit with the chute 105 (FIG. 1) of the lower banner arm 54, the geometric shape of the lower crossbar is selectable. In the best mode embodiment, the cross-sectioned trapezoidal shape is chosen to conform to that of the chute 105, which as described in detail hereinafter with respect to FIGS. 8 through 11 has a trapezoidal cross section. As with the upper crossbar 95, the lower crossbar housing 120 is preferably made of steel, however, such alternative materials as are deemed suitable by those skilled in the art may also be used.

Referring again to FIG. 1, the present banner mounting system 50 permits mounting of the banner at the required heights from ground level, by incorporating a rotatable crank assembly 130, which is installed between a shaft connector 131 to the upper banner arm 52, and extends through the lower arm to a crank assembly coupling 132. The assembly coupling 132 is a female-type connector which is adapted to receive a male connector 134 disposed at the distal end of a removable crank extension 136. The extension 136 has a handle 138 which allows a person, such as an installer, to releasably engage the male connector 134 with the female connector 132 and use the handle 138 to rotate 140 the crank extension 136 and crank assembly 130 in clockwise and counterclockwise directions to raise and lower the banner 55.

Since the upper and lower brackets are positioned as necessary to accommodate banners of various standard heights, the crank assembly 130 is provided as a telescopic unit. This is provided by having a crank section 130A which fits within a section 130B and may be positioned at any one of a plurality of set points 142. Similarly, the crank extension 136 and its connector 134 is designed to easily engage the connector 132 of the crank assembly 130 to hoist and remove a banner, but may then be removed, thereby providing protection against banner theft and vandalism.

Figure 2:
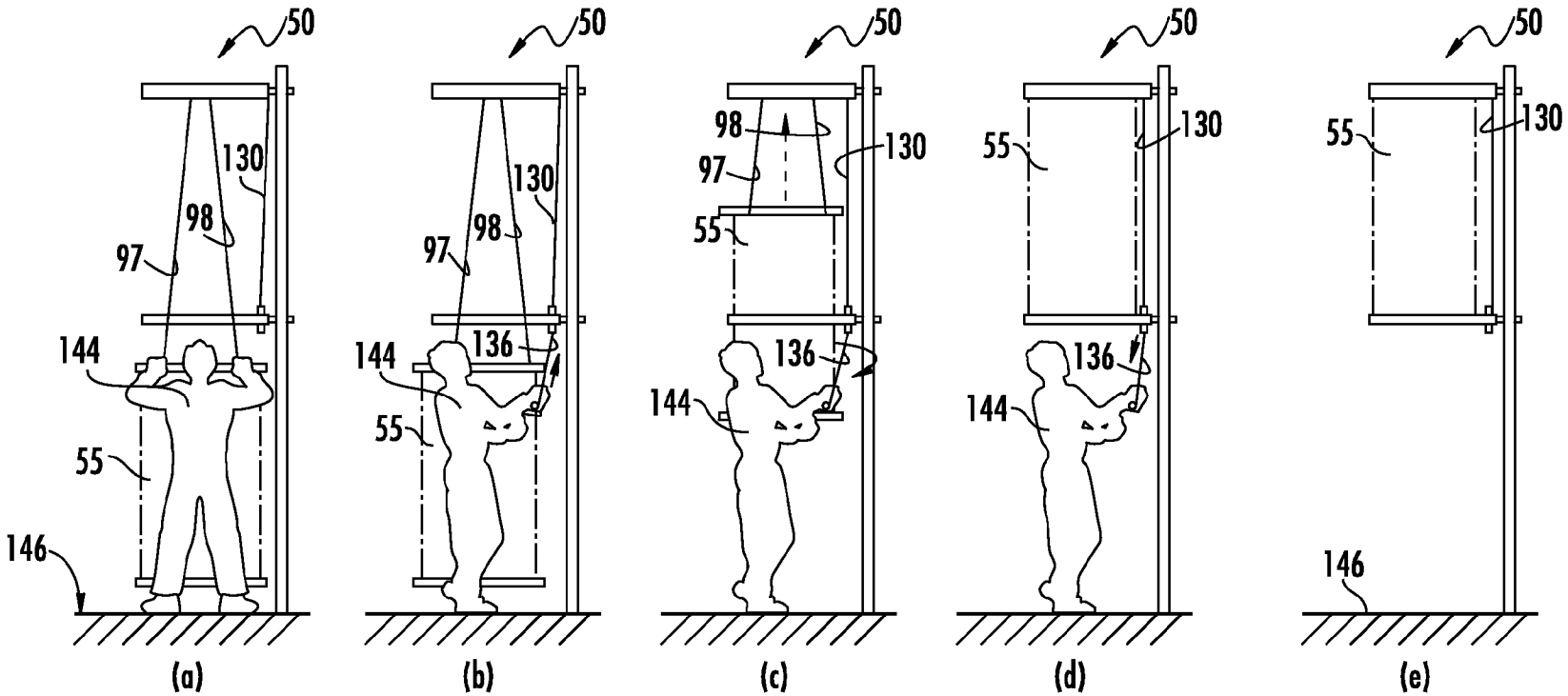
FIG. 2, is a figurative illustration used in teaching the operation of the embodiment of FIG. 1.

FIG. 2, illustrations (a) through (e) provide a visual teaching of the steps performed by an installer in mounting the banner 55 onto the system 50 of FIG. 1. The illustrations are not necessarily precise, but are intended only as a figurative demonstration of how the invention simplifies the mounting task. In illustration (a) an installer 144 located at the base of the pole 56, at ground level 146, inserts the assembled banner (112, FIG. 12) into the upper and lower crossbars 95, 96. In illustration (b) the installer engages the connector 134 of the extension 136 into connector 132 of the crank assembly 130, and in illustration (c) rotates (cranks) the assembly 130 to retract the halyard lines 97, 98 and hoist the banner into position. In illustration (d) the banner is mounted in position and the installer removes the extension 136, allowing the crank assembly to lock in position and hold the banner in place. Illustration (e) shows the banner mounted in position and the extension removed so as to emphasize the security and protection against tampering that the removable crank alone provides. Added mounting system features provide further theft security, as described below.

Figure 7:
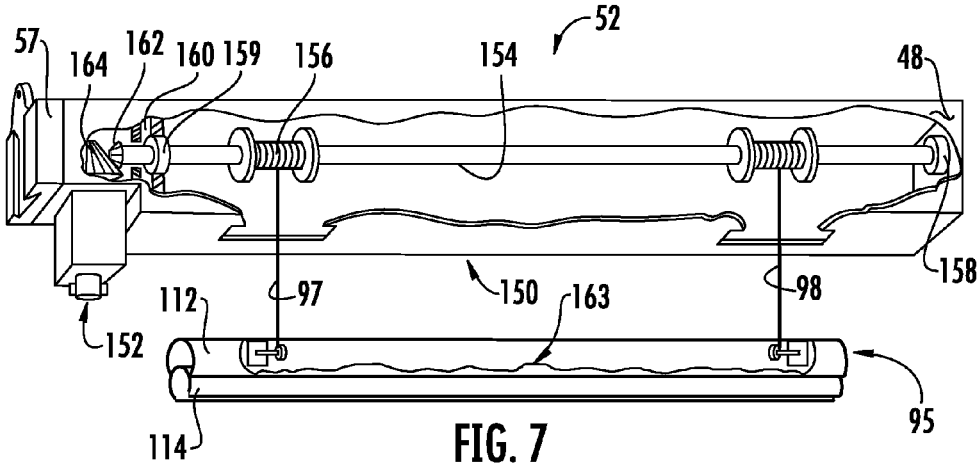
FIG. 7, is a perspective, cutaway illustration, not to scale, of still yet another component of the System embodiment of FIG. 1.

Referring now to FIG. 7, which is a perspective, cut away illustration, not to scale, of the upper banner arm 52 as it appears by itself; removed from its mounting on the pole 56. The upper banner as a housing 148 that encloses a hoist section 150 and a drive section 152, and terminates at the arm's mounting end with the connector 57. In the best mode embodiment the housing is metal, preferably 3 mm (approximately ⅛ inch) thick aluminum. It should be understood, however, such other materials as are deemed suitable by those skilled in the art may also be used. The housing has an overall length of approximately 900 mm (approximately 35 and 7/16 inches). The connector 57, as described hereinbefore with respect to FIG. 3, is secured to the housing 148 with fasteners, and adds an approximately additional 30 mm, (1 and 3/16 inches) to the overall length. The housing has a rectangular, nominally square cross section which is 80×80 mm (3 and 3/16 inches square).

The hoist section 150 is 818 mm (approximately 32 and 3/16 inches), or more than 90 percent of the overall length. The length of the drive section 152 is nominally 82 mm (approximately 3 and ¼ inches). As illustrated in the cut away, the hoist section 150 includes a cylindrical drive shaft 154, which is 40 mm (approximately 1 and 9/16 inches) in diameter and which includes shaft mounted spools 156 and 157 that receive the halyard lines 97, 98. The drive shaft 154 extends the length of the drive section 150, from a shaft ball bearing 158 mounted at one end wall of the housing, to a ball bearing 159 mounted in a housing partition wall 160 between the drive and hoist sections, and terminates in a minor bevel gear 162 that is located within the drive section 152. The overall length of the drive shaft is 841 mm (approximately 33 and ⅛ inches).

The drive shaft 154 and mounted spools 156, 157 function as a winch in hauling in and releasing the halyard lines 97, 98 during the hoisting and lowering of the banner 55. The halyard lines are connected to the upper crossbar 95 and in a best mode embodiment they comprise a single line, rather than two separate lines. In other words the line 97, which is spooled from spool 156, enters the cylinder 112 and is threaded internally through the cylinder along the path 163, and exits as halyard line 98 which is received by the shaft spool 157. The advantage of a single halyard line is in its ability to allow "self righting" of the upper crossbar during hoisting and lowering of the banner 55.

Within the drive section 150 the minor bevel gear 162 is one of a bevel gear set, which includes major bevel gear 164. As known, bevel gears are conically shaped, and are used when it is necessary to change the direction of rotation of a shaft. In the present embodiment, as described below with respect to FIG. 6, the major bevel gear 164 is connected through a self-locking drive train assembly located within sub-housing 166, and the shaft connector 131, to the crank assembly 130 (FIG. 1), which is nominally displaced at ninety degrees (90°) from the drive shaft 154. Therefore, the axes of the gears 162, 164 are similarly displaced by ninety (90°) degrees.

Figure 6:
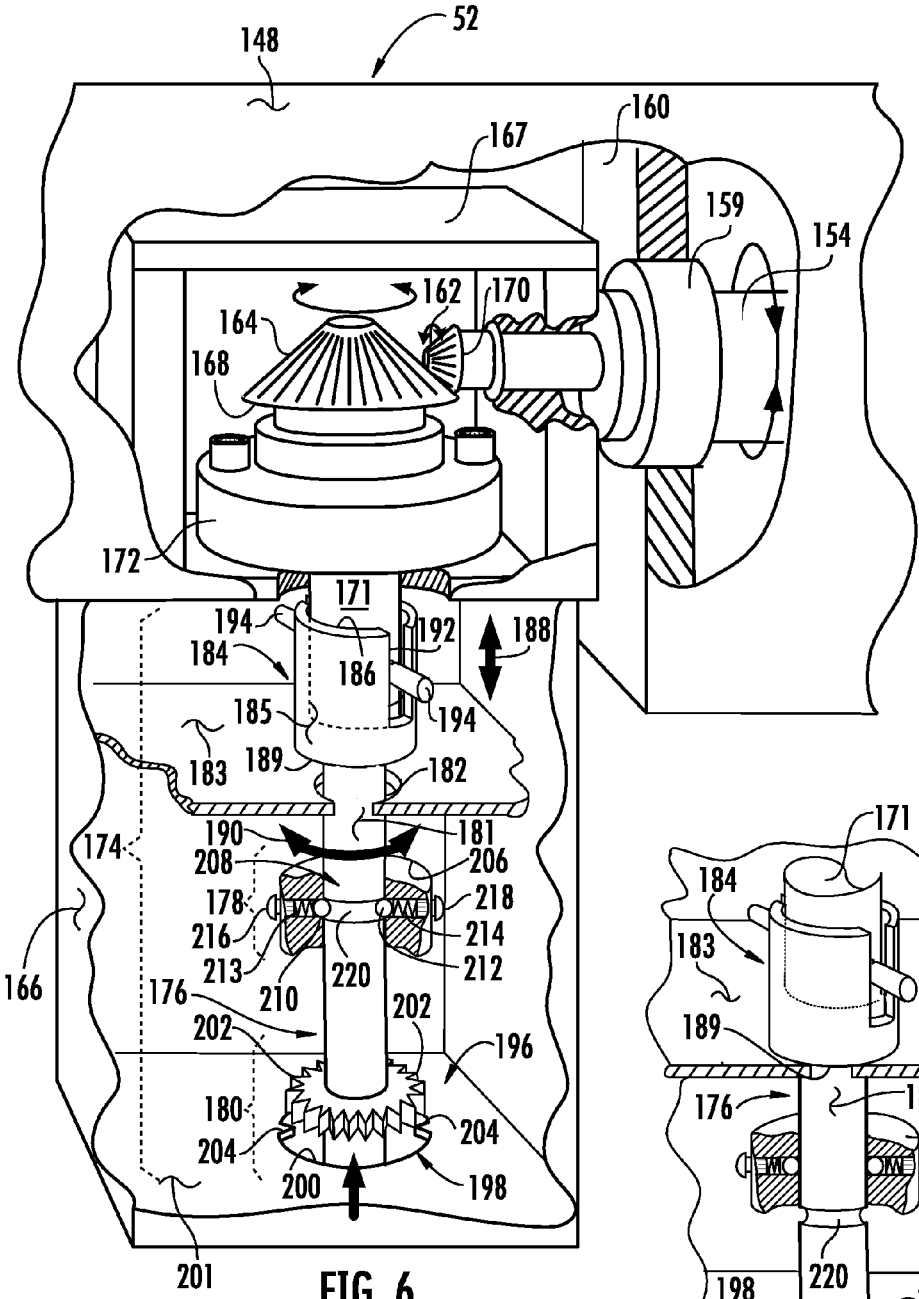
FIG. 6, is a perspective, elevated sectioned view, not to scale, of still yet another component of the System embodiment of FIG. 1.

Referring now to FIG. 6, which is a cut away illustration, not to scale, of the drive section 152 of the upper banner arm 52 and of the sub-housing 166. In the best mode embodiment the major and minor bevel gears 164, 162 are mounted within a gear box assembly 167, which is located in the drive section 150 of the housing 148. The gears 162, 164 are made of steel, and in the best mode embodiment have a straight gear tooth design. It is understood, however, that such alternative materials to steel as are deemed suitable by those skilled in the art for use in this application may also be used. Similarly as known to those skilled in the art, alternative gear tooth designs, such as spiral teeth, may be used. The major bevel gear 164 has a 35 millimeter (mm) (1⅜ inch) diameter base 168 and forty eight (48) gear teeth which, for the ninety degree (90°) offset required by the current embodiment, are disposed at a forty five degree (45°) angle bevel in relation to the base. The minor bevel gear 162 has a 15 mm (19/32 inch) diameter base 170 and twelve (12) gear teeth disposed at a forty five degree (45°) angle bevel in relation to its base. This produces a one-to-four gear ratio, so that one revolution of the crank assembly 130 (FIG. 1) produces four revolutions of the drive shaft 154.

The gear shaft 171 of major bevel gear 164 is connected through a shaft bearing assembly 172 within the gear box 167, to the self-locking drive train assembly 174 located within sub-assembly 166. The sub-housing 166, similar to the upper arm housing 148 is an aluminum metal housing which is nominally 3 mm (approximately ⅛ inch) thick. The drive train assembly 174 includes a drive shaft 176, a position locking device 178, and a shaft lock assembly 180. The drive shaft 176 comprises a linear steel shaft 181 that extends upward from the shaft lock assembly 180 through an opening 182 in a deck plate 183 of the sub-housing 166, and terminates at a first end in a shaft coupler 184. It terminates at its distal end (not shown in FIG. 6) in the shaft connector 131 (FIG. 1).

The shaft coupler 184 is in the form of a socket, with a steel housing 185 that encloses a central aperture 186 which is adapted to slidably engage the gear shaft 171. The depth of the aperture is selected to ensure that gear shaft 171 remains within the aperture as the shaft coupler travels with the drive shaft over a reciprocal range of travel 188 that occurs with operation of the system 50. In the current embodiment, this is a vertical range of motion which is limited in its downward stroke by the base 189 of the shaft coupler 184 coming into contact with the deck plate 183. This is intended as a fixed stop which, as described hereinafter with respect to the shaft lock 180, coincides with the locked state of the drive shaft 176. In the locked state the drive shaft 176 cannot rotate.

When not in the locked state the drive shaft 176 rotates in clockwise and counterclockwise directions 190 in keeping with the like rotation 140 (FIG. 1) of the crank extension 136 (FIG. 1) by an operator or installer. To transmit the drive shaft rotational to the major bevel gear 164, the coupler 184 includes a pair of longitudinal channels that are cut into opposite sides of the coupler's outer wall 185, as shown by the slot 192 on the visible side of the coupler. The channels are in fluid communication with the aperture 186 and are adapted to receive the opposite ends of a steel locking pin 194 that is installed through the gear shaft 171. The position of the locking pin 194 on the shaft 171 is chosen to ensure that the pin 194 remains within the confine of the channels (192) over the range of reciprocal travel 188 of the drive shaft 176. As the coupler 184 rotates with the drive shaft 176 the walls of the channels 192 make contact with and bear on the locking pin 194 and impart the rotational forces of the drive shaft to the gear shaft 171.

The reciprocal range of travel 188 of the drive shaft 176 is the linear distance that the drive shaft has to travel between its locked to its unlocked state, as provided by the shaft lock assembly 180. The shaft lock assembly 180 comprises a locking gear 196 that is fixedly mounted to the lower portion of the steel shaft 181 of the drive shaft 176, and a shaft lock 198 that comprises an aperture 200 formed in the bottom plate 201 of the sub-housing 166. In the best mode embodiment the locking gear 196 is nominally 7 mm (approximately 9/32 of an inch) thick, with eighteen (18) gear teeth 202 that radially project 10 mm (approximately 13/32 inches) from its base to provide it with an outer diameter of 24 mm (approximately 15/16 inch). The aperture 200 is provided at a nominal 28 mm (approximately 1 and 7/64 inches) diameter so as to allow the locking gear 196 to fit within and pass through the aperture.

Figure 6A:
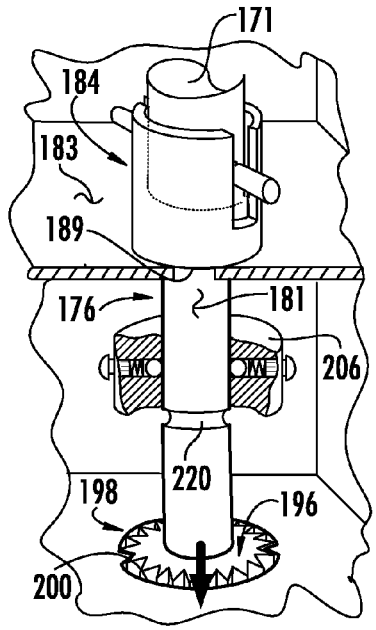
FIG. 6A, is a perspective, elevated view of the component of FIG. 6 in an alternative operating state.

The aperture, however, is also provided with two or more locking teeth 204 that are disposed at equal intervals along the circumference of the aperture 200, and extend a nominal 3.5 mm (approximately 9/64 inches) into the center of the aperture. If the locking gear 196 is nested within the aperture, as by lowering it into the aperture and having an operator rotate the drive shaft 176 using the crank extension 136 (FIG. 1) until the gear teeth 202 are capable of meshing with the locking teeth 204, the locking gear is prevented from further turning and the drive shaft is locked. However, the 24 mm diameter locking gear is capable of passing through the 28 mm diameter aperture, so the steel shaft 181 must be held in its vertical position to maintain this locked state. In the best mode embodiment this is accomplished by the base 189 of the shaft coupler 184 coming into contact with, and resting on, the deck plate 183. This provides a positive stop to the downward travel of the locking gear 196 and maintains the drive shaft 176 in its locked state. FIG. 6A illustrates the drive shaft 176 in its locked position with the base 189 of the shaft coupler 184 resting on the deck plate 183 and the locking gear 196 nested within the aperture 200 of the shaft lock 198.

FIG. 6 illustrates the drive shaft assembly 176 in the unlocked state, with the locking gear 196 suspended above the shaft lock 198. In the unlocked state the drive shaft may be rotated in either direction 190 by the installer in raising and lowering he banner 55. To prevent the drive shaft assembly from falling back into its locked position due to gravitational forces, and to eliminate the need for the installer to have to maintain an upward force on the crank extension 136 (FIG. 1, the position locking device 178 holds the drive shaft in its unlocked position. The position locking device 178 includes a housing 206 with a central aperture 208 which receives the steel shaft 181 of the drive shaft in a sliding engagement manner to permits reciprocal motion 188 of the shaft. To allow for the clarity of illustration necessary to teach the function of the position locking device 178, FIGS. 6, 6A do not show the mounting apparatus for the housing 206, which is otherwise standard and of a type known to those skilled in the art. Similarly, although shown as having a substantially annular shape, the housing 206 may be provided in any form suitable for performance of the position locking device function, as described hereinafter.

The position locking device 178 has at least two tensioned lock stops. In the best mode embodiment each lock stop comprises a steel ball 210, 212 that is held in tension against the surface of the steel shaft 181 by springs 213, 214, which are held in position in the housing 206 by fasteners 216, 218, which are threaded into the housing. The steel shaft 181 includes a circumscribed groove 220 which is substantially 4 mm (approximately 5/32 inches) deep and substantially 4 mm (approximately 5/32 inches) wide. The groove 220 functions as an annular detent. Although maintained under tension, the steel balls 210, 212 roll along the surface of the shaft 181 readily, when upward force is applied to the shaft 181 by the action of the installer in unlocking the drive shaft 176 until the steel balls are placed in registration with, and forced into, the groove 220.

The force of the springs 213, 214 is sufficient to maintain the balls within the 4 mm (3/32 inch) depth of the groove against the sum of the gravitational forces exerted on the drive shaft by the combined weight of the shaft coupler 184, steel shaft 181, the FIG. 1 shaft connector 131, crank assembly 130, and the crank extension 136. With the drive shaft supported and maintained in the unlocked position by position locking device 178, the installer need only provide the rotational force necessary to raise or lower the halyard lines 97, 98 to mount or remove the banner 55. When the operation is complete, the installer may overcome the tension of the springs 213, 214 by applying downward pressure on the drive shaft 176 through the engagement of the connectors 132, 134 of the crank assembly 130 and crank extension 136, thereby allowing the drive train assembly 174 to fall to its locked position. When complete, the connectors 132, 134 may be disengaged and the crank extension removed, thereby preventing unauthorized persons from lowering and stealing the banner.

Referring again to FIG. 1, from the description of operation of the system 50 provided hereinbefore with respect to FIG. 2, it is understood that the installer connects the upper and lower crossbars 95, 96 to the banner 55 at ground level. To do this the upper crossbar must be lowered to the ground and with its length $L_T$ and width $W_T$ less than the length X and width Y of the chute 105 ($L_T$<X and $W_T$<Y) the crossbar passes through the chute 105 of the lower banner arm 54 to reach ground level. The assembled banner and crossbars are then raised into their mounted position. The upper crossbar, together with the banner, passes through the chute 105. The lower crossbar 96, however, is designed to provide an interference fit with the chute 105, and it is captured and nested within the chute under force of the tension applied by the halyard lines 97, 98. With the lower crossbar nested in the chute, the installer may further rotate the crank extension 136 to provide the banner 55 with a taut mounting. The drive shaft 176 may then be locked, which locks the drive train assembly 174, as described above with respect to FIG. 6, to maintain the banner in position.

Figure 8:
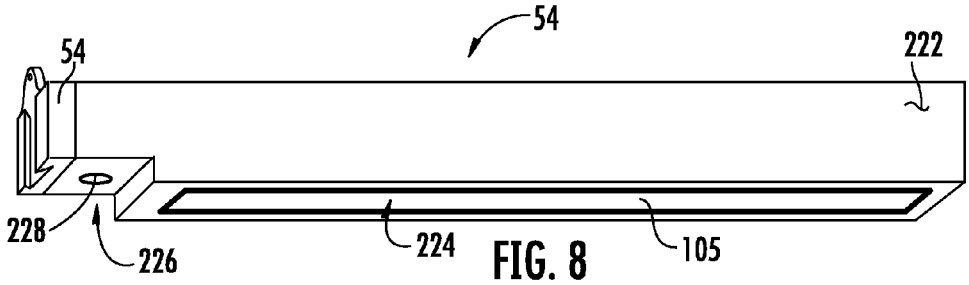
FIG. 8, is a perspective illustration, not to scale, of still yet another component of the System embodiment of FIG. 1.

Referring now to FIG. 8, which is a perspective illustration, not to scale, of the lower banner arm 54 as it appears removed from its mounting to the pole 58 (FIG. 1). The banner arm 54 has a housing 222 which is metal, preferably 3 mm (approximately 1/8 inch) thick aluminum. It should be understood, however, as with the upper banner arm housing 148 (FIG. 7), that such other materials as are deemed suitable by those skilled in the art may also be used. The housing 222 has an overall length of 900 mm (approximately 35 and 7/16 inches), and a width of 81 mm (approximately 3 and 3/16 inches), and is divided along its length into a banner portion 224 and a crank assembly portion 226. The banner portion 224 of the housing 222 encloses the chute 105, and has a height of 50 mm (approximately 2 inches), and the crank assembly portion 226 of the housing 222 encloses the crank assembly 130 (FIG. 1) and in the best mode embodiment has a slightly smaller height of 41.5 mm (approximately 1 and 5/8 inches). It should be understood, however, that the different heights of these two sections is an elected condition and that the entire housing may be of equal height if so elected by the user. The crank assembly portion 226 includes an aperture 228 which receives the crank assembly 130 in the fully assembled system 50.

Figure 9:
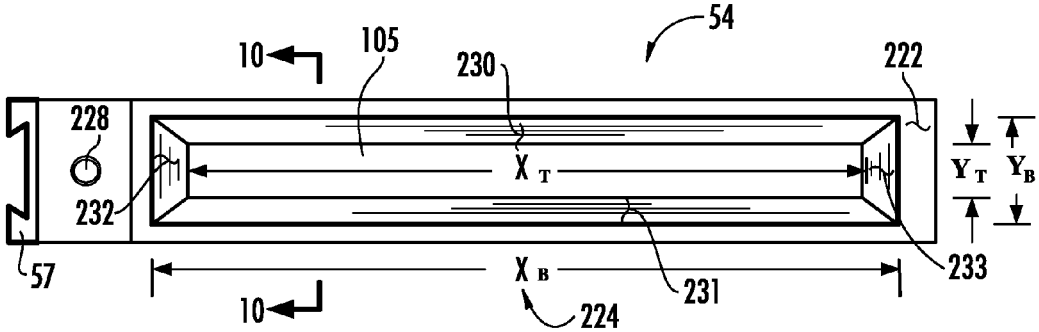
FIG. 9, is a plan view of one surface of the component illustrated in FIG. 8.
Figure 10:
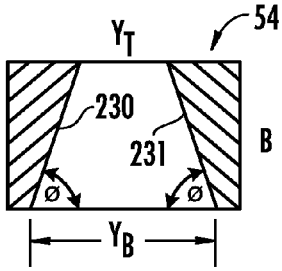
FIG. 10 is a section view taken along the line 10-10 of FIG. 9.

FIG. 9 is a plan view, not to scale, of the lower banner arm of FIG. 8, and illustrates the chute 105 with front and back walls 230, 231 and side walls 232, 233 which taper from a bottom length $X_B$ and bottom width $Y_B$ to a top length $X_T$ and top width $Y_T$, where: $X_B>X_T$ and $Y_B>Y_T$. FIG. 10 is an elevated section of the lower banner arm housing 222 taken along the line 10-10 of FIG. 9. In this section drawing the front and back walls 230, 231 of the chute 105 are shown to have substantially equal lengths and equal base angles $\phi$ so that the cross section geometry is substantially that of an isosceles trapezoid. In the best mode embodiment the base angle $\phi$ is seventy (70) degrees.

Figure 11:
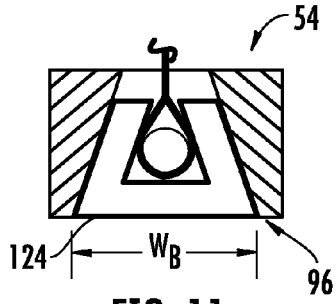
FIG. 11, is the section view of FIG. 10 showing an operating state of the system component of FIGS. 8 and 9.

FIG. 11 is a representative illustration the lower crossbar 96, shown in cross section, nested within the lower banner arm 54, as shown by the cross section of FIG. 10. As described hereinbefore with respect to FIG. 1, the width $W_B$ of the crossbar 96 is greater than the width $Y_B$ of the bottom of the chute 105, so that the crossbar 96 becomes captured in a nested position within the chute 105. This is not a friction fit. The crossbar is held in its mounting position within the chute by the tension of the banner 55 and halyard lines 97, 98 when the drive train assembly 174 (FIG. 6) is in its locked position. When the drive train is unlocked, the force of gravity causes the lower crossbar to drop from the chute with the lowering of the banner 55.

Figure 18:
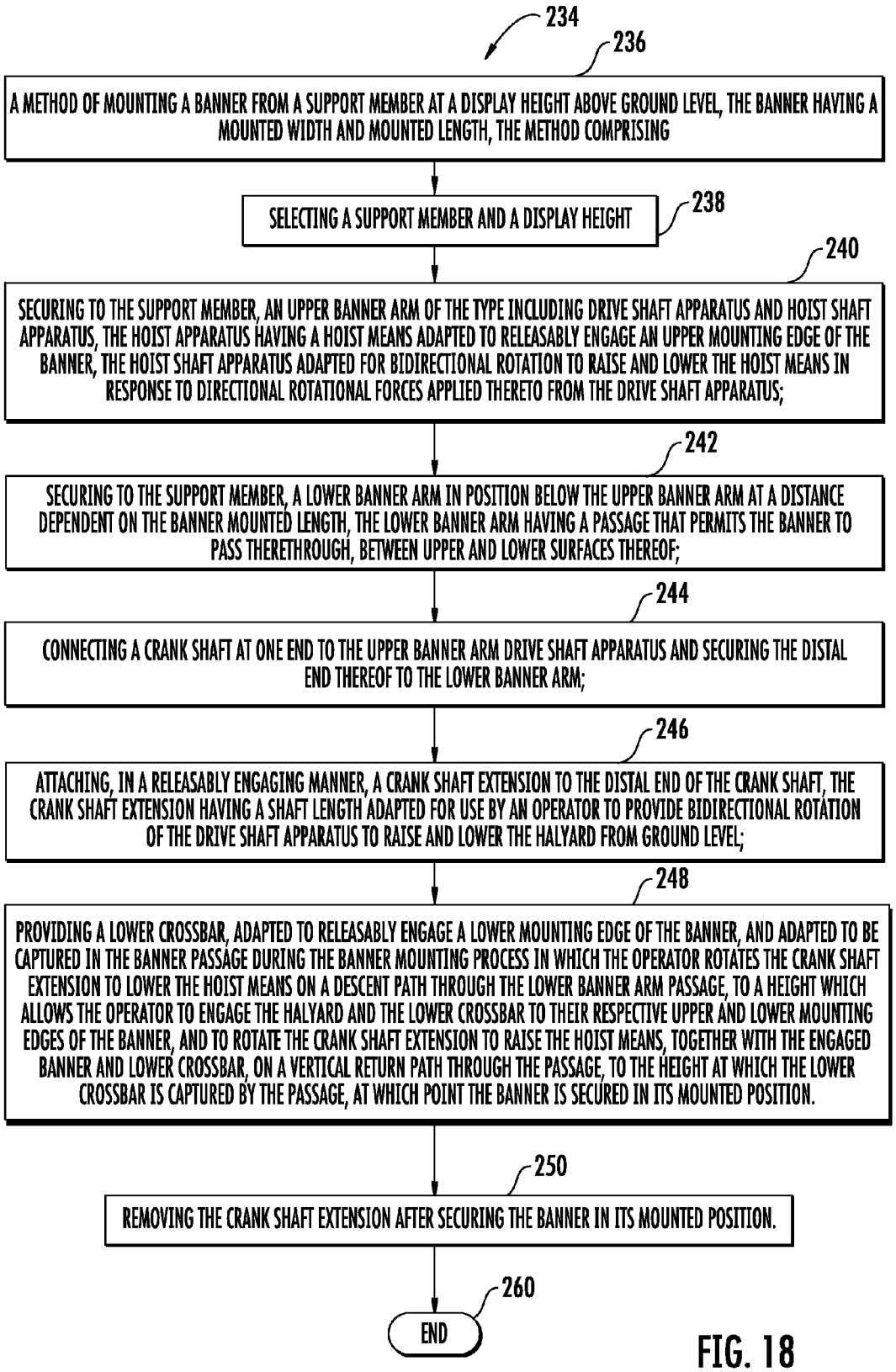
FIG. 18, is a flow chart which diagrams the steps performed by the present invention in mounting a banner.

Referring now to FIG. 18, which is a flow chart diagram of the method steps performed by the present invention in mounting a banner. The method 234 begins with the statement of the method objective at 236 which is to mount a banner from a support member at a given display height above ground level. The first step 238 is to select the support member and the display height. Step 240 describes the mounting of an upper banner arm to the support member. The upper banner arm having drive shaft apparatus and hoist shaft apparatus. The hoist shaft apparatus being adapted for bidirectional rotation in response to rotational torque received from the drive shaft apparatus. The hoist shaft apparatus having hoist means adapted to releasably engage an upper mounting edge of the banner and to be raised and lowered between ground level and the display height in response to bidirectional rotation of the hoist shaft apparatus.

Step 242 describes mounting a lower banner arm to the support member. The lower banner arm having a banner passage between its upper and lower surfaces that permits the banner to pass through. Step 244 connects one end of a crank shaft to the upper banner arm drive shaft apparatus and secures the distal end of the crank shaft to the lower banner arm for support. Step 246 attaches a crank shaft extension to the crank shaft distal end in a releasably engaging manner. The crank shaft extension having a shaft length adapted for use by an operator located at ground level to provide bidirectional rotation of the crank shaft and the drive shaft apparatus to raise and lower the hoist means.

Step 248 provides a lower crossbar which is adapted to releasably engage a lower mounting edge of the banner, and adapted also to be captured in the banner passage of the lower banner arm during the banner mounting process in which the operator rotates the crank shaft extension to lower the hoist means on a descent path through the banner passage, to a height which allows the operator to engage the hoist means and the lower crossbar, respectively, to the upper and lower edges of the banner, and to rotate the crank shaft extension to raise the hoist means on a return ascent path through the banner passage, together with the engaged banner and lower crossbar, to a height at which the banner passage blocks further vertical travel of the lower crossbar, at which point the banner is secured in its mounted position. With the banner secured in its mounting, step 250 has the operator remove the crank shaft extension, and the method ends at 260.

As described, the banner mounting system 50 of the present invention provides secure, taut mounting of standard sized banners at preferred elevations by an installer who can mount and dismount the banner from ground level. This can be done without the need for a ladder, and the safety concerns that may involve, or the assistance of a bucket truck that must be scheduled in advance. The only equipment needed is the crank extension 136 (FIG. 1). This provides the user with the ability to safely and quickly change banners, while at the same time providing the banner with a degree of security against theft or vandalism. The ability to remove the crank extension minimizes the opportunity for banner theft and/or vandalism, and the taut mounting minimizes furling of the banner to provide stable and steady presentation of the banner's text or graphics to onlookers, thereby improving its utility to users. The system's ease of use, and the efficiency it brings to the process of banner display, is a significant improvement over all known alternatives.

Figure 19:
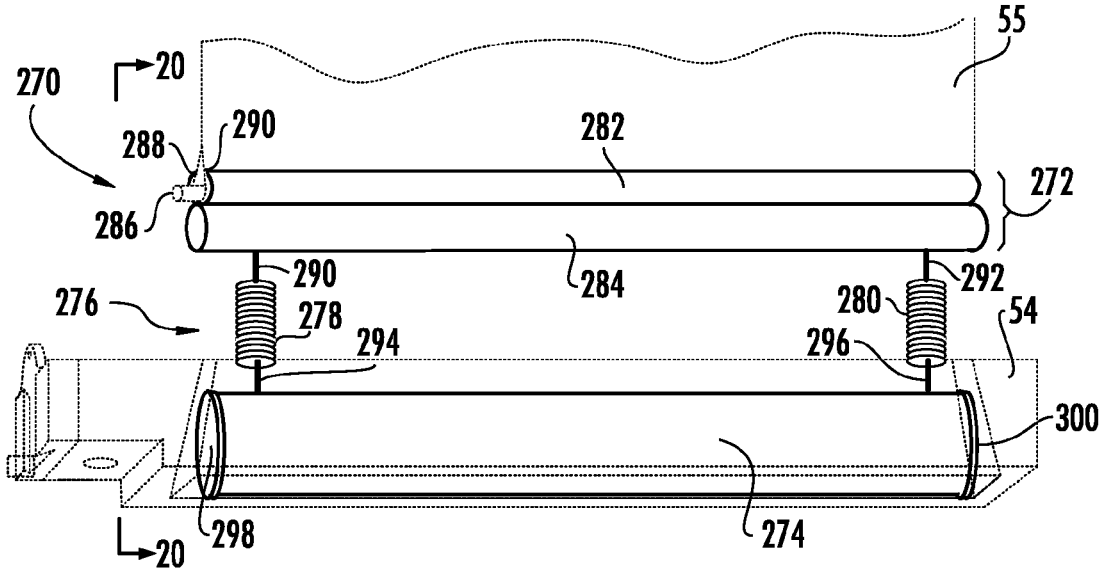
FIG. 19 is a perspective illustration, not to scale, of an alternative embodiment of one component of the system embodiment of FIG. 1.

In certain applications or mounting locations where higher ambient wind conditions may damage the banner, an alternative banner mounting system embodiment replaces the single lower crossbar 96 with a double lower crossbar arrangement that provides the mounted banner with a variable tautness so as to limit wind damage to the banner. Referring to FIG. 19, in a perspective illustration of the double lower crossbar embodiment 270 in its operative state of mounting the banner 55 (shown in phantom) to the lower banner mounting arm 54 (also shown in phantom), a first lower crossbar segment 272 is adapted to releasably engage the banner 55 and to fixedly, but flexibly engage a second lower crossbar segment 274 through a flexible coupling 276.

In the best mode embodiment the flexible coupling 276 comprises metal springs 278, 280. The springs 278, 280 have a nominal length of 127 mm (5 inches) when they are not under tension, i.e. in their "unloaded state", and they are provided with an elasticity that allows them to increase their length by a factor of two or more to 254 mm (10 inches), under the tension of an anticipated maximum force to be exerted on the banner by the wind. Elasticity is determined by the spring's force constant (or "spring constant") k, which is defined by Hook's law (F=k x), as:

$$k=F/x$$

where: x is the distance the spring is elongated; and

F is the restoring force exerted by the spring.

The first lower crossbar segment 272 comprises a two piece aluminum tube assembly formed as a single unit. It is similar to the upper crossbar 95 (FIGS. 1, 7), where a smaller diameter tube 282 is mounted to a larger diameter tube 284. The smaller diameter tube 282 is adapted to receive and support the banner rod 286 enclosed within banner sleeve 288, and includes a longitudinal slot 290 formed along its length to allow the banner 55 to pass through. The larger diameter tube 284 is adapted for connection to the flexible coupling 276, which in the best mode embodiment requires it to fixedly engage one end of each of the springs 278, 280. Preferably this includes eyelets formed in the large diameter tube body which function as the mounting site to mechanically secure the cabling 290, 292 of each of the springs 278, 280 to the body of the large diameter tube using mechanical fasteners, such as screws or such other suitable equivalent.

The second lower crossbar segment 274 is also made of aluminum, and is adapted in its dimensions to nest in, but not pass through, the chute 105 of the lower banner arm assembly 54 (FIGS. 1, 8, 9). To achieve this the segment 274 is provided with a diameter and tube length which is less than the bottom width $Y_B$ and bottom length $X_B$ of the chute 105, but greater than the top width $Y_T$ and top length $X_T$ of the chute to thereby allow the lower crossbar segment 274 to nest in chute 105 when the banner is raised. The second lower crossbar segment is also adapted to fixedly engage the opposite side of the flexible coupling 276, which in the best mode embodiment is to mechanically fasten the cabling 294, 296 for the springs 278, 280 to eyelets formed in the second lower crossbar segment housing using mechanical fasteners, such as screws or such other suitable equivalent.

A further aspect of this alternative embodiment of the lower crossbar 96 (FIG. 1) is the addition of weight to the double lower crossbar arrangement to provide further stability to the banner when it is being mounted and/or dismounted under windy conditions. In the best mode embodiment this is achieved by adding sand to the interior of the second lower crossbar segment 274, and to provide end caps 298, 300 to retain the sand within the segment. The added weight allows the segment 274 to pull the banner down through the chute in the presence of ambient wind conditions. The added weight is nominally two pounds but can vary (higher or lower) depending on the installation.

Figure 20:
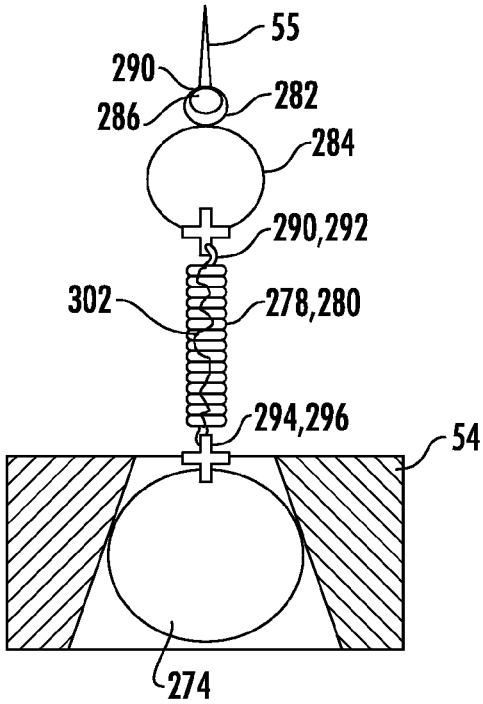
FIG. 20 is a side elevation view taken along line 20-20 of FIG. 19.

Referring to FIG. 20, an elevated section of the assembly 270 taken along the line 20-20 of FIG. 19, the springs 278, 280 are each shown to include a safety cable 302 which is threaded through the interior of the springs and secured to the mechanical mounting sites of the cabling 290, 292, 294 and 296. The cable 302 preferably comprises stainless steel, and is provided at a length which is selected to limit the overall extension of the springs 278, 280 to a selected maximum extension, such as 305 mm (12 inches), under sever wind conditions.

The alternative embodiment of the lower crossbar allows the banner to move at an angle to the wind direction by rotating around a vertical axis (one spring stretching more than the other). It also allows for proper stretching of the mounted banner in the absence of wind, without requiring that the upper and lower banner arms 52, 54 (FIG. 1) be installed at an exact distance. The recommended spaced distance of the mounted upper and lower banner arms depends upon the banner height, and their installation within +/−1" of the banner height will allow for a properly stretched banner, while leaving at least an additional 10 inches of potential spring elongation.

Although the invention has been shown and described with respect to a best mode embodiment thereof, it should be understood by those skilled in the art that various changes, omissions, and additions may be made to the form and detail of the disclosed embodiment without departing from the spirit and scope of the invention, as recited in the following claims.

I claim:

1. Apparatus for mounting a banner from a support member at a display height above ground level, the banner having a mounted width and mounted length, the apparatus comprising:

an upper banner arm assembly, having an upper arm housing adapted to be secured to the support member at a location dependent on the display height, and including drive shaft apparatus and hoist shaft apparatus disposed within the upper arm housing, the hoist shaft apparatus being adapted for bidirectional rotation in response to rotational torque received thereby from the drive shaft apparatus, the drive shaft apparatus imparting the rotational torque in response to like rotational torque provided thereto from a crank assembly, the hoist shaft apparatus having hoist means adapted to releasably engage an upper mounting edge of the banner, and to be raised and lowered between ground level and the display height in response to bidirectional rotation of the hoist shaft apparatus;

a crank assembly, having a crank shaft fixedly engaged at one end to the drive shaft apparatus, the crank shaft having a distal end, the crank assembly adapted for operator use in applying bidirectional rotational torque to the drive shaft apparatus;

a lower banner arm assembly, having a lower arm housing adapted to be secured to the support member in spaced relationship with the upper banner arm housing, in dependence on the banner mounted length, the lower arm housing having a banner passage extending between upper and lower surfaces thereof, the banner passage having passage geometry that permits the banner to pass therethrough; and a lower crossbar, adapted to releasably engage a lower mounting edge of the banner, and having a lower crossbar geometry that prevents it from passing through the banner passage during the banner mounting process in which the operator rotates the crank assembly in a direction which lowers the hoist means, directing it on a descent path through the banner passage, to a height which permits the operator to engage the hoist means and the lower crossbar, respectively, to the upper and lower mounting edges of the banner, and to rotate the crank assembly in a direction which raises the hoist means on a return ascent path through the banner passage, together with the engaged banner and lower crossbar, to a height at which the banner passage blocks further vertical travel of the lower crossbar, at which point the banner is secured in its mounted position.

2. The apparatus of claim 1, wherein the lower arm housing further comprises crank assembly support means disposed thereon, the crank assembly support means adapted to receive and fixedly engage the crank assembly, in proximity to the crank shaft distal end.

3. The apparatus of claim 2, wherein the crank shaft comprises a variable length to accommodate variations in the mutual spacing of the upper banner arm housing and the lower banner arm housing as mounted on the support member.

4. The apparatus of claim 3, wherein the crank shaft comprises first and second crank shaft segments, the first shaft segment adapted at one end to fixedly engage the drive shaft apparatus and the second shaft segment adapted at one end to function as the crank shaft distal end, the opposite ends of both segments being adapted to slidably engage each other in a telescopic fashion to provide a variable length shaft.

5. The apparatus of claim 4, wherein the first and second shaft segments are each further adapted to fixedly engage each other at a plurality of spaced intervals along the shaft of each, as necessary to adjust the length of the crank assembly to the mutual spacing of the upper arm housing and the lower arm housing.

6. The apparatus of claim 2, further comprising a crank assembly extension having an extension shaft adapted at one end to operatively engage the distal end of the crank assembly, and having a handle at the distal end thereof for use by the operator in rotating the crank assembly from ground level;

as characterized by:

the crank assembly extension being adapted to releasably engage the distal end of the crank assembly, thereby being capable of operator removal when not in use.

7. The apparatus of claim 2, wherein:

the hoist shaft apparatus further includes a hoist shaft disposed in and axially extending along a longitudinal portion of the upper arm housing, the hoist shaft having a driven end for receiving bidirectional rotational torque from the drive shaft apparatus, the hoist shaft responding thereto by axially rotating in like bidirectional manner, to raise and lower the hoist means, the hoist means being raised and lowered through one or more hoist shaft apertures disposed in a lower surface of the upper arm housing, and wherein:

the drive shaft apparatus comprises a drive shaft and a gear train disposed within the upper arm housing, the drive shaft having a driven end and a driving end thereto, the driven end extending through a drive shaft aperture formed in the lower surface of the upper arm housing to fixedly engage the crank shaft and to thereby be rotated by the crank shaft, at a speed and direction dependent on the rotational torque applied to the crank shaft by an operator, the gear train having a driving gear and a driven gear, the driving gear being fixedly engaged to the driving end of the drive shaft and the driven gear being fixedly engaged to the driven end of the hoist shaft, whereby bidirectional rotational torque applied by the operator to the crank shaft is transmitted through the drive shaft and gear train to the hoist shaft.

8. The apparatus of claim 7, wherein the gear train comprises bevel gears which change the axis of rotation of the drive shaft to that of the hoist shaft.

9. The apparatus of claim 7, wherein the hoist means comprises:

an upper crossbar, adapted to releasable engage the upper mounting edge of the banner, the upper crossbar having an upper crossbar geometry that allows it to pass through the banner passage during the banner mounting process; and one or more halyard lines, connected to the upper crossbar and the hoist shaft, the halyard lines being wound and unwound on and from the hoist shaft when raising and lowering the upper crossbar, the halyard lines having sufficient length to lower the crossbar to the operator.

10. The apparatus of claim 7, wherein the drive shaft comprises tandem upper and lower drive shaft segments which are coaxially aligned, the upper drive shaft segment including the drive shaft driving end which is fixedly engaged to the driving gear of the gear train, causing the upper drive segment to remain stationary in position, the lower drive shaft segment including the drive shaft driven end which projects through the drive shaft aperture to fixedly engage the crank shaft so as to rotate and move linearly with like rotation and linear displacement of the crank shaft by the operator, the upper and lower drive shaft segments being adapted at their distal ends to slidably engage each other in a manner that transmits the rotational and linear motion of the lower shaft segment to the upper shaft segment, the lower drive shaft segment further including locking means disposed thereon, the locking means being adapted to nest in the drive shaft aperture in the absence of an upward linear displacement of the crank shaft by the operator, and when so nested, to prevent rotation of the lower drive shaft segment, thereby locking the drive shaft and the hoist shaft in their then present position.

11. The apparatus of claim 10, wherein the locking means comprises:

a locking disk, disposed on the lower drive shaft, the locking disk having two or more disk protrusions disposed along a locking disk circumference thereof, the protrusions each projecting radially outward from the disk circumference to a disk protrusion circumference;

and wherein:

the drive shaft aperture has an aperture circumference equal to or greater than the disk protrusion circumference, and includes one or more aperture protrusions disposed therealong, the aperture protrusions projecting radially inward to an aperture protrusion circumference which is equal to or greater than the locking disk circumference, the aperture protrusions being adapted to nest between adjacently disposed disk protrusions with nesting of the locking disk within the drive shaft aperture, thereby preventing axial rotation of the lower drive shaft segment by the operator's rotation of the crank shaft.

12. The apparatus of claim 11, wherein:

the locking disk comprises a gear wheel, having a plurality of gear teeth disposed along the locking disk circumference, the gear teeth projecting radially outward therefrom to the disk protrusion circumference;

and wherein:

The drive shaft aperture comprises one or more pairs of aperture protrusions disposed along the aperture circumference, each protrusion of each such pair being disposed oppositely each other along the aperture circumference.

13. The apparatus of claim 10, wherein:

the banner passage comprises a chute having four walls that taper from a first rectangular area at the lower surface of the lower banner arm housing to a second rectangular area at the upper surface of the lower banner arm housing, to provide a banner passage geometry in which the second rectangular area is smaller than the first rectangular area;

and wherein:

the lower crossbar is provided with an exterior surface geometry that is adapted in dimension and contour in respect of the banner passage geometry to permit the lower crossbar to be raised up into the banner passage chute with operator rotation of the crankshaft during the banner mounting process to a mounted position in which the lower crossbar is substantially nested within the chute, the banner passage geometry thereafter preventing further vertical travel of the lower crossbar and further operator rotation of the crank shaft, the lower crossbar being held in its nested position with actuation of the locking means in response to the downward travel of the drive shaft with the operator's release of upward force on the crankshaft.

14. The apparatus of claim 13, wherein the lower crossbar is lowered from its mounted position in the banner passage chute by upward force of the operator on the crankshaft, to displace the locking disk from the drive shaft aperture and permit rotation of the drive shaft.

15. Apparatus for mounting a banner from a support member at a display height above ground level, the banner having a mounted width and mounted length, the apparatus comprising:

an upper banner arm assembly, having an upper arm housing adapted to be secured to the support member, at a location dependent on the display height, and projecting therefrom at an upper arm housing length, the upper arm housing including drive shaft apparatus and hoist shaft apparatus disposed therein, the hoist shaft apparatus including hoist means adapted to releasably engage an upper mounting edge of the banner, and a hoist shaft connected to the hoist means and extending axially along a portion of the upper arm housing length, the hoist shaft having a driven end for receiving bidirectional rotational torque from the drive shaft apparatus and responding thereto by axially rotating in like bidirectional manner to raise and lower the hoist means between ground level and the display height, the drive shaft apparatus including a drive shaft and a gear train disposed within the upper arm housing, the drive shaft having a driven end and a driving end thereto, the driven end extending through a drive shaft aperture formed in the lower surface of the upper arm housing to fixedly engage a crank assembly which rotates the drive shaft at a speed and rotational direction which is dependent on the rotational torque applied to the crank assembly by an operator, the gear train having a driving gear and a driven gear, the driving gear being fixedly engaged to the driving end of the drive shaft and the driven gear being fixedly engaged to the driven end of the hoist shaft, whereby bidirectional rotational torque applied by the operator to the crank assembly is transmitted through the drive shaft and gear train to the hoist shaft.

a crank assembly, having a crank shaft and a crank shaft extension, the crank shaft having a driving end fixedly engaged to the driven end of the drive shaft and a driven end adapted to releasably engage a driven end of the crank shaft extension, the crank shaft extension having a length which facilitates operator use at ground level to apply bidirectional rotational torque through the crank shaft, to the drive shaft, to raise and lower the hoist means, and to be removed by the operator when not in use;

a lower banner arm assembly, having a lower arm housing adapted to be secured to the support member in spaced relationship with the upper banner arm housing, in dependence on the banner mounted length, and projecting therefrom at a lower arm housing arm length, the lower arm housing having a banner passage extending between upper and lower surfaces thereof, and along a portion of the lower arm housing length, the banner passage having a passage geometry that permits the banner to pass therethrough, the lower arm housing further having a crank shaft support means disposed thereon to receive and support the crank shaft thereto, in proximity to the crank shaft driven end; and a lower crossbar, adapted to releasably engage a lower mounting edge of the banner, and having a lower crossbar geometry that prevents it from passing through the banner passage during the banner mounting process in which the operator rotates the crank shaft extension to lower the hoist means on a descent path through the banner passage, to a height which permits the operator to engage the hoist means and the lower crossbar, respectively, to the upper and lower mounting edges of the banner, and to rotate the crank shaft extension to raise the hoist means on a return ascent path through the banner passage, together with the engaged banner and lower crossbar, to a height at which the banner passage blocks further vertical travel of the lower crossbar, at which point the banner is secured in its mounted position.

16. The apparatus of claim 15, wherein the drive shaft comprises upper and lower drive shaft segments which are coaxially aligned, in tandem, the upper drive shaft segment including the drive shaft driving end which is fixedly engaged to the driving gear of the gear train, the lower drive shaft segment including the drive shaft driven end which projects through the drive shaft aperture to fixedly engage the crank shaft so as to rotate and move linearly with like rotation and linear displacement of the crank shaft by the operator, both drive shaft segments adapted at their distal ends to slidably engage one another in a manner that communicates the rotational and linear motion of the lower drive shaft segment to the upper drive shaft segment, the lower drive shaft segment further including a locking means disposed on its shaft, the locking means adapted to nest in the drive shaft aperture in the absence of upward linear displacement of the crank shaft by the operator, and when so nested, to prevent rotation of the lower drive shaft segment, thereby locking the drive shaft and the hoist shaft in their then present position.

17. The apparatus of claim 16, wherein:

the locking means comprises a gear wheel, having a plurality of gear teeth disposed along the gear wheel inner circumference and projecting radially outward therefrom to a gear wheel outer circumference;

and wherein:

the circumference of the drive shaft aperture is adapted to receive the gear wheel in nested relationship therein, the drive shaft aperture having one or more aperture protrusion extending radially inward, the aperture protrusions each adapted in their spacing around the drive shaft aperture circumference and in their length to fit between and mesh with the gear teeth of the gear wheel when the gear wheel is nested in the drive shaft aperture, thereby preventing rotation of the drive shaft.

18. The apparatus of claim 16, wherein:

the banner passage comprises a chute having four walls that taper from a first rectangular area at the lower surface of the lower banner arm housing to a second rectangular area at the upper surface of the lower banner arm housing, to provide a banner passage geometry in which the second rectangular area is smaller than the first rectangular area;

and wherein:

the lower crossbar is provided with an exterior surface geometry that is adapted in dimension and contour in respect of the banner passage geometry to permit the lower crossbar to be raised up into the banner passage chute with operator rotation of the crankshaft during the banner mounting process to a mounted position in which the lower crossbar is substantially nested within the chute, the banner passage geometry thereafter preventing further vertical travel of the lower crossbar and further operator rotation of the crank shaft, the lower crossbar being held in its nested position with actuation of the locking means in response to the downward travel of the drive shaft with the operator's release of upward force on the crankshaft.

19. The apparatus of claim 18, wherein the hoist means comprises:

an upper crossbar, adapted to releasable engage the upper mounting edge of the banner, the upper crossbar having an upper crossbar geometry that allows it to pass through the banner passage during the banner mounting process; and one or more halyard lines, connected to the upper crossbar and the hoist shaft, the halyard lines being wound and unwound on and from the hoist shaft when raising and lowering the upper crossbar, the halyard lines having sufficient length to lower the crossbar to within reach of the operator at ground level.

20. The apparatus of claim 19, wherein the lower crossbar comprises:

a first lower crossbar segment adapted to releasably engage a lower mounting edge of the banner, and adapted in its width and length dimensions to cause the first lower crossbar segment to pass through the banner passage chute;

a second lower crossbar segment adapted in its width and length dimensions to cause the second lower crossbar to be raised up into and nest within the banner passage chute in response to the operator's raising of the banner to its mounted position, and to prevent the further vertical travel thereof with continued rotation of the crankshaft by the operator; and a flexible coupling adapted to fixedly engage the first lower crossbar segment to the second lower crossbar segment in an elastic manner which permits the first lower crossbar segment to travel vertically with continued operator rotation of the crankshaft following nesting of the second lower crossbar segment in the banner passage chute, thereby providing the mounted banner with a variable degree of tautness.

21. The apparatus of claim 20, wherein the flexible coupling comprises two or more metal springs that are fixedly engaged between the first lower crossbar segment and the second lower crossbar segment.

22. The apparatus of claim 21, wherein the second lower crossbar segment is adapted to contain therein user added material weight which increases the gravitational force exerted by the second lower crossbar segment on the mounted banner, thereby providing increased guidance of the upper crossbar, banner, and first lower crossbar segment through the banner passage chute during the mounting and dismounting of the banner.

23. A method of mounting a banner from a support member at a display height above ground level, the banner having a mounted width and mounted length, the method comprising:

securing an upper banner arm to the support member, the upper banner arm including drive shaft apparatus and hoist shaft apparatus, the hoist apparatus having a halyard adapted to releasably engage an upper mounting edge of the banner, the hoist shaft apparatus adapted for bidirectional rotation to raise and lower the halyard in response to directional rotational forces applied thereto from the drive shaft apparatus;

securing a lower banner arm to the support member, in position below the upper banner arm at a distance dependent on the banner mounted length, the lower banner arm having a passage that permits the banner to pass therethrough, between upper and lower surfaces thereof;

connecting a crank shaft at one end to the upper banner arm drive shaft apparatus and securing the distal end thereof to the lower banner arm;

attaching, in a releasably engaging manner, a crank shaft extension to the distal end of the crank shaft, the crank shaft extension having a shaft length adapted for use by an operator to provide bidirectional rotation of the drive shaft apparatus to raise and lower the halyard from ground level;

providing a lower crossbar, adapted to releasably engage a lower mounting edge of the banner, and adapted to be captured in the banner passage during the banner mounting process in which the operator rotates the crank shaft extension to lower the halyard on a descent path through the lower banner arm passage, to a height which allows the operator to engage the halyard and the lower crossbar to their respective upper and lower mounting edges of the banner, and to rotate the crank shaft extension to raise the halyard, together with the engaged banner and lower crossbar, on a vertical return path through the passage, to the height at which the lower crossbar is captured by the passage, at which point the banner is secured in its mounted position.

24. The method of claim 23, further comprising the step of:

removing the crank shaft extension after securing the banner in its mounted position.

* * * * *